United States Patent [19]

Friedman, deceased et al.

[11] 4,203,457

[45] May 20, 1980

[54] ATTACHABLE PORTABLE UMBRELLA

[76] Inventors: Meyer Friedman, deceased, late of Flushing, N.Y.; by Elizabeth Friedman, administrix, 56-59 Hollis Court Blvd., Flushing, N.Y. 11365

[21] Appl. No.: 885,811

[22] Filed: Mar. 13, 1978

[51] Int. Cl.[2] ..... A45B 11/02

[52] U.S. Cl. ..... 135/5 C; 135/35 V; 224/187

[58] Field of Search ..... 135/5 C, 35 V; 224/5.7

[56] References Cited

U.S. PATENT DOCUMENTS

| | | | |
|---|---|---|---|
| 1,031,974 | 7/1912 | Thomas | 135/35 V |
| 1,217,542 | 2/1917 | Washington | 224/187 |
| 1,368,516 | 2/1921 | McCourt | 224/189 |
| 1,803,538 | 5/1931 | Pistole | 135/5 C |
| 2,227,554 | 1/1941 | Riordon | 135/5 C |
| 2,434,526 | 1/1948 | Thornton | 135/5 C |
| 3,032,047 | 5/1962 | Wendorf | 135/35 V |

*Primary Examiner*—C. J. Husar
*Assistant Examiner*—Conrad L. Berman
*Attorney, Agent, or Firm*—Howard I. Podell

[57] ABSTRACT

A collapsible umbrella which is detachably mounted to the shoulders of a garment so as to be supported above the head of a wearer of the garment, in the opened position of the umbrella. A pair of semi-rigid strut members are pivotally mounted each to a tip of an opposed umbrella rib and to a hinged bracket fastened to an external top shoulder section of a garment with a pair of flexible tension members, one fastened to the top of a forward umbrella rib and the other to a top of a rear umbrella rib each fastened respectively to a forward and a rear section of the garment. The ribs are each pivotally joined by individual semi-rigid stretcher members to a tubular handle that is slidably mounted over a central post to the top of which the ribs are all pined such that sliding of the handle towards the top of the central post extends the umbrella ribs. A flexible covering is fastened to the ribs and the post top, with vent holes located in the upper portion of the covering that are covered by a flexible flap section fixed to the post top.

5 Claims, 13 Drawing Figures

ATTACHABLE PORTABLE UMBRELLA

PRIOR ART

Collapsible umbrellas are described in U.S. Pat. Nos. 3,386,455; 3,456,661; 3,559,661; 3,361,145; 3,419,026; and 3,693,643, but such prior inventions do not suggest the structure of my invention nor the advantages of use of my invention which is designed to be fitted to a garment of a wearer, in the open position, so that the wearer is shielded from rain without the necessity of holding an umbrella with either of his hands as is necessary with the use of conventional umbrellas.

SUMMARY OF THE INVENTION

My invention is a collapsible umbrella which is detachably mounted to the shoulders of a garment so as to be supported above the head of a wearer of the garment, in the opened position of the umbrella. A pair of semi-rigid strut members are pivotally mounted each to a tip of an opposed umbrella rib and to a hinged bracket fastened to an external top shoulder section of a garment with a pair of flexible tension members, one fastened to the top of a forward umbrella rib and the other to a top of a rear umbrella rib each fastened respectively to a forward and a rear section of the garment. The ribs are each pivotally joined by individual semi-rigid stretcher members to a tubular handle that is slidably mounted over a central post to the top of which the ribs are all pined such that sliding of the handle towards the top of the central post extends the umbrella ribs. A flexible covering is fastened to the ribs and the post top, with vent holes located in the upper portion of the covering that are covered by a flexible flap section fixed to the post top.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
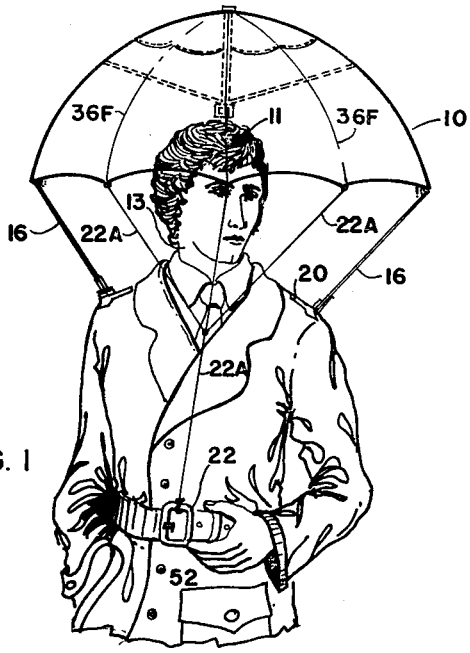
FIG. 1 is a front perspective view of my invention in use.
Figure 2:
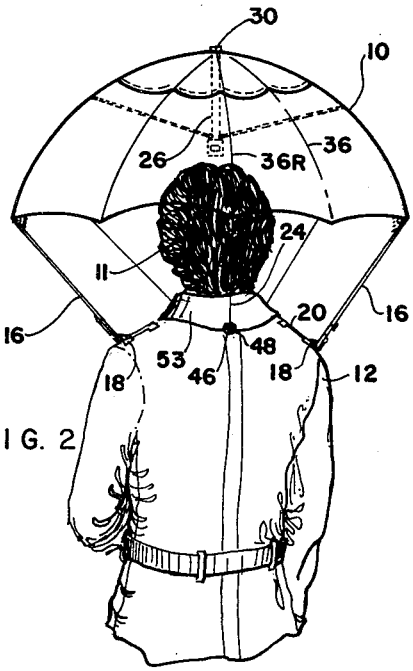
FIG. 2 is a rear perspective view of my invention in use.

Turning now descriptively to the drawings, in which similar reference characters denote similar elements throughout the several views, FIGS. 1 and 2 illustrate the opened umbrella 10 supported above the head 11 of the wearer 13 of coat 12 by a pair of semi-rigid struts 16 each detachably fastened to a bracket assembly 18 detachably fastened to the exterior of the top of the shoulder section 20 of the coat, with a pair of flexible tension members 22, 24 fastened to the front and rear of the coat, respectively. Tubular handle 26 of the umbrella is telescoped in the open umbrella position over fixed center post 28 of the umbrella so as to be supported by the post 28 above and clear of the head 11 of the wearer.

Figure 3:
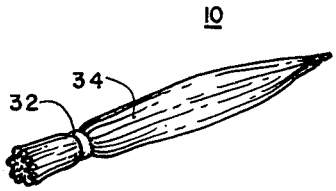
FIG. 3 is a perspective view of the umbrella, when folded.
Figure 7:
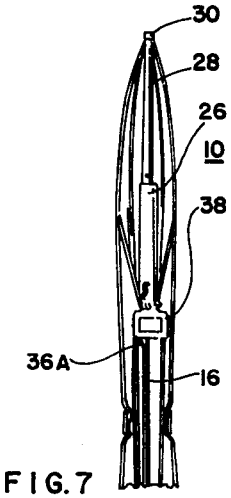
FIG. 7 is a detail interior side view of the umbrella, when folded.
Figure 8:
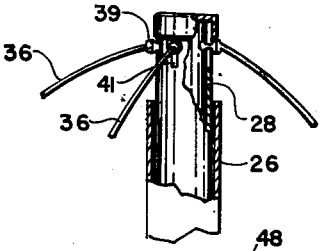
FIG. 8 is a detail perspective side view of the umbrella post.

In the collapsed detached state of the umbrella 10, as shown in FIGS. 3 and 7, handle 26 is slid on post 28 away from the top section 30 of the post 28 and a flexible strap 32 is fastened about the collapsed umbrella cover sheet 34 fastened externally about the umbrella ribs 36. The free end of the handle is shaped with an O-shaped grip section 38.

Figure 6:
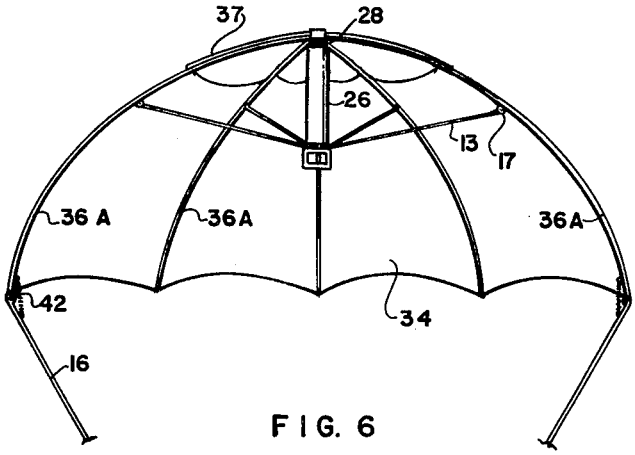
FIG. 6 is a detail interior side view of the umbrella, when open.

As shown in FIGS. 1, 2 and 6, each of the umbrella ribs 36 is fastened to the top section of post 28 by a pin 39 fitting into a slot 41 of the post 28, at a first upper end of each rib. A second lower end of each of two opposed side ribs 36A is pivotally joined by a hinge joint 42 to a top end of an individual strut 16, with a spring mounted about the joined rib and strut to bias the strut towards the umbrella rib. Struts 16 are each of shorter length than ribs 36 and 36A so as completely fold into the interior of the collapsed umbrella, as shown in FIG. 7.

A flexible tension member 24 joins the lower end of a rear rib 36R and terminates in a loop 46 which may be detachably hooked by rear fastener assembly 48 that is detachably fastened to the rear section of coat 12. A flexible tension member 22 that may be fastened to the belt buckle 52 of the coat is joined to three tension members 22A that are each joined to a lower end of the three front ribs 36F of the umbrella.

Each rib 36 is joined at an intermediate position by a hinge joint 17 to a first end of a semi-rigid compression member 13, the second end of which is pivotally joined to the lower section of the handle 26 so that with handle 26 telescoped over post 28 and slid towards the top section of post 28, the ribs 36 are extended away from the post to open the umbrella. A latch member is pivotally mounted on handle 26 and located to engage a recess in the side of post 28 in the open position of the umbrella.

Figure 9:
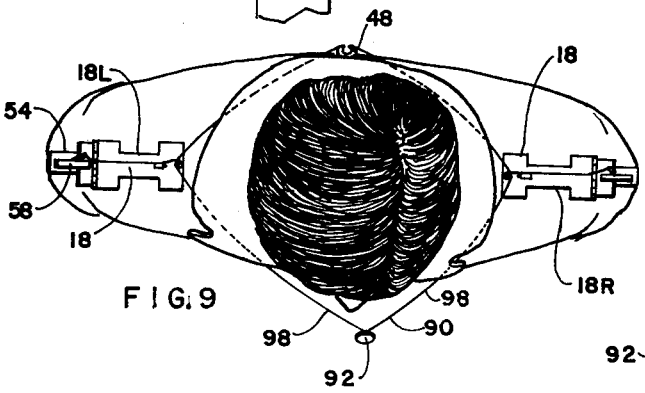
FIG. 9 is a top plan view of the garment to which the umbrella is fitted.
Figure 10:
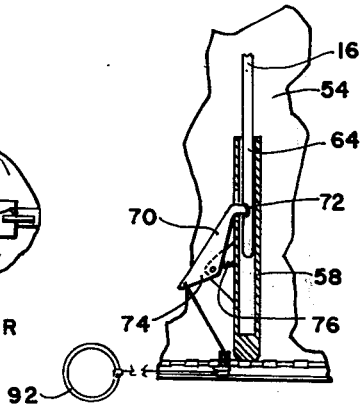
FIG. 10 is a side sectional view of a shoulder bracket of the garment.
Figure 12:
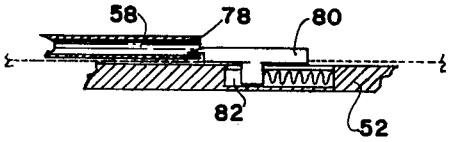
FIG. 12 is a detail side sectional view of the shoulder bracket.
Figure 11:
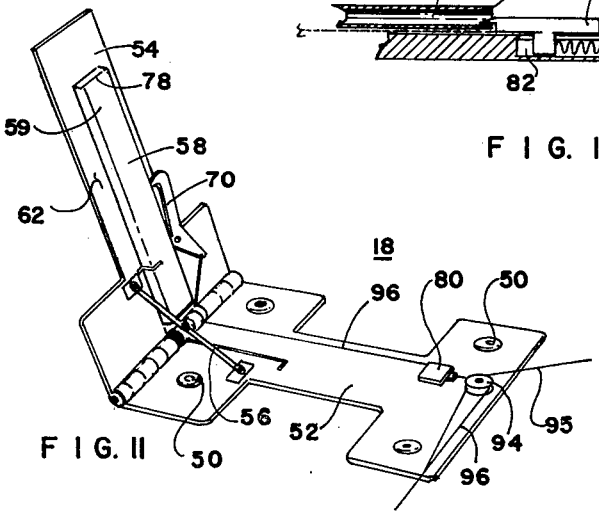
FIG. 11 is a perspective view of a shoulder bracket of the garment.

FIG. 11 illustrates a shoulder bracket assembly 18 that is detachably mounted by snap fasteners 50 to the top of the shoulder section 20 of the coat, with FIG. 9 illustrating one such bracket assembly 18L in the open position and the other assembly 18R in the closed position. Each bracket assembly 18 is formed of a base plate 52 that rests on the coat section 20 to which snap fasteners 50 are fixed and a cover plate 54 pivotally hinged to the base plate, with a pivoted strut unit 56 pivotally mounted to each plate to retain both plates in the open position in the extended mode of strut unit 56, with cover plate extending vertically upwards in the open position from horizontally mounted base plate 52. A hollow sleeve 58, open to the top end 59 of sleeve 58, is fixed to the interior face 62 of cover plate 54 of a size to engage the bottom leg section 64 of a strut 16 in the interior of sleeve 58 in the erect position of the umbrella. A recess 72 in the leg section 64 is engaged by a latch lever 70 pivoted about pin 74 on a bracket fixed to sleeve 58, with compression spring 76 biasing the latch into the engaged position.

In the folded position of assembly 18, with strut 16 removed from engagement, the rim 78 of sleeve 58 is engaged by a beveled latch detent 80 slidably mounted in a groove 82 in base plate 52 with compression spring in groove 82 biasing the latch to the engaged position. Latch detent 80 automatically is slid opened by rim 78 as rim 78 is pressed towards the bevel latch surface so as to reclose again when the sleeve 58 rests against base plate 58 in the closed folded position of cover plate 54.

Figure 13:
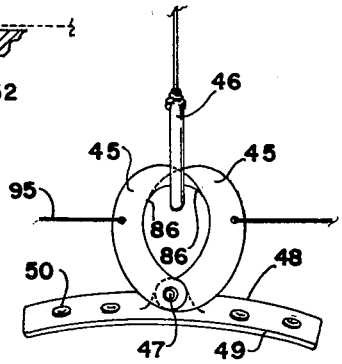
FIG. 13 is a rear view of the back fastening bracket of the garment.

A pair of open C-shaped hooks 45 are pivotally mounted by pin 47 in a hinge bracket fixed to base strip 49 of rear fastener assembly 48, with strip 49 detachably fastened by snap fasteners 50 to the rear of the coat below the lapel 52. A torque spring (not shown) about pin 47 biases hooks 45 to the overlapping closed position shown in FIG. 13 to retain loop 46, with the inside surfaces 86 shaped in a concave manner to ensure engagement of hooks 45 about loop 46 when tension is applied to rear tension member 24, fastened about loop 46.

A flexible release string assembly 90 fits about the front of the wearer to terminate in a finger grip 92, and extend about a fixed pulley 94 on each shoulder base plate 52 and with a string 95 extending from each pulley 94 to a hook 45. Another string 96 of the assembly extends about an opposed face of the pulley 94 to join slidable latch detent 80 and latch lever 70 such that tension on each string 94 opens a hook 45 and tension on each string 96 slides detent 80 and pivots lever 70 to the open disengaged position. Each string 96 and 95 is joined forward of the pulley 94 to a pull string 98 attached to grip 92.

Thus manual tension on grip 92, with bracket assembly in the folded position, prior to mounting of the umbrella, causes cover plate 54 to pivot to the open position for attachment of a strut in sleeve 58, and simultaneously opens hooks 45 to permit fitting loop 46 from the opened umbrella in a hook 45. Release of the tension on grip 92 causes latch lever 70 to bear against and latch to strut 16 and both hooks 45 to retain loop 46.

Similarly, manual tension applied to grip 92 causes latch lever 70 to be disengaged from strut recess 72 for release of the strut and permits manual removal of loop 46 from opened hooks 45. The cover plate is readily latched to base plate when so folded after tension is released from grip 92.

Figure 4:
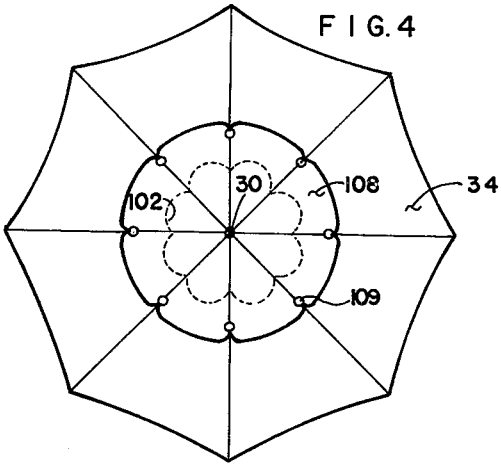
FIG. 4 is a plan view of the umbrella, when open.
Figure 5:
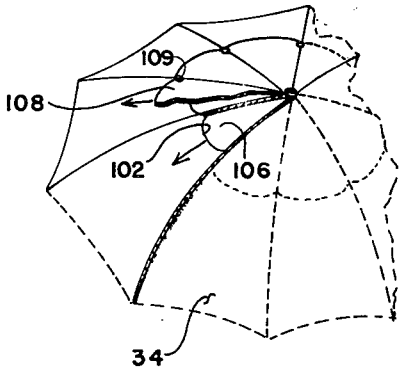
FIG. 5 is a detail perspective view of the umbrella, when open.

As shown in FIGS. 4–5, the cover sheet 34 of the umbrella is externally fastened to each rib 36 and extends short of the center post to terminate in a scallop shaped rim 102 bounding an open central opening 106. A circular shaped flexible cover flap 108 is fixed to post 30 and extends freely over ribs 36 to overlap the cover sheet 34 with cover flap fixed at peripheral points 109 to ribs 36 through cover sheet 34 by stitching staples, eyelets or pins. Air is freely vented through opening 106 from under the umbrella cover 34 and between the circular rim of flap 108 and cover sheet 34 between each pair of adjacent ribs 36, without permitting rim to penetrate in the reverse direction, since reduced air pressure under the umbrella draws cover flap 108 tightly against cover 34.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A collapsible umbrella which is detachably mounted to a garment of a wearer so as to be supported, in use, in the opened position of the umbrella above the head of the wearer, comprising an umbrella assembly formed of ribs radially fastened at a first end of each rib to a top section of a post, a tubular handle section telescopically slidably mounted about said post, means joining said handle section and said ribs so as to cause said ribs to extend away from said post when the handle is moved to a first position towards the top section of said post and to draw towards said post in a collapsed position of the umbrella when the handle section is moved to a second position away from the top section of the post, a flexible covering externally fastened to said ribs, two compression members, each pivotally mounted to a second end of each of two ribs, and two flexible tension members, each fastened to a second end of each of two other ribs, together with means to detachably fasten the said compression members to a garment, together with a pair of first brackets each adaptable for mounting externally on the shoulder section of a coat and each fitted with means for detachable fastening to one of the compression members.

2. The combination as recited in claim 1, together with a second bracket fitted with a hook that is adaptable for detachable mounting externally on the back section of a coat, said hook shaped to detachably engage a shaped end of a said tension member.

3. The combination as recited in claim 1, in which each of the first and said brackets are fitted with individual latch means for fastening to the compression and tension members respectively, with all said latch means joined to a common latch release means.

4. A collapsible umbrella which is detachably mounted to a garment of a wearer so as to be supported, in use, in the opened position of the umbrella above the head of the wearer, comprising an umbrella assembly formed of ribs radially fastened at a first end of each rib to a top section of a post, a tubular handle section telescopically slidably mounted about said post, means joining said handle section and said ribs so as to cause said ribs to extend away from said post when the handle is moved to a first position towards the top section of said post and to draw towards said post in a collapsed position of the umbrella when the handle section is moved to a second position away from the top section of the post, a flexible covering externally fastened to said ribs, two compression members, one end of each being pivotally mounted respectively to a second part of each of two ribs at a spaced distance from said first end of each rib, and two flexible tension members, a first end of each being fastened respectively to a second part of each of two other ribs at a spaced distance from said first end of each rib, together with means to detachably fasten a second end of each of the said compression members to a garment, and means to detachably fasten a part of each of the said tension members to said garment, said means each located at a spaced distance from the said first end of each said tension member.

5. The combination as recited in claim 4, in which the flexible covering is formed with a central open section, concentric with the top section of the post, and in which a flexible flap section of sheet material is fastened to the top section of the post and extends over said open section and overlaps onto the flexible covering, with said flap section fastened at its periphery to each of the ribs, but otherwise not fastened to the flexible covering so as to form a vent opening between segments of the flap section and covering bounded by adjacent radial ribs.

* * * * *